US006264584B1

(12) United States Patent
Bass

(10) Patent No.: US 6,264,584 B1
(45) Date of Patent: Jul. 24, 2001

(54) TREADMILL SUPPORT BELT

(76) Inventor: Lennon Bass, 56 Coursen Pl., Staten Island, NY (US) 10304

( * ) Notice: Subject to any disclaimer, the term of this patent is extended or adjusted under 35 U.S.C. 154(b) by 0 days.

(21) Appl. No.: 09/566,143

(22) Filed: May 5, 2000

(51) Int. Cl.[7] ..... A63B 22/00
(52) U.S. Cl. ..... 482/54; 482/69
(58) Field of Search ..... 482/51, 54, 66, 482/67, 69, 70, 71

(56) References Cited

U.S. PATENT DOCUMENTS 4,655,447 4/1987 Dubrinsky .
5,158,510 * 10/1992 Lemire ..... 482/51
5,176,597 1/1993 Bryne .
5,234,392 8/1993 Clark .
5,704,880 1/1998 Amatulle .

* cited by examiner

*Primary Examiner*—Glenn E. Richman
(74) *Attorney, Agent, or Firm*—Goldstein Law Offices P.C.

(57) ABSTRACT

A treadmill support belt including a belt portion adapted for coupling with a treadmill user. A back support is secured to the belt portion. The back support is defined by an upper edge, a lower edge, and opposed side edges. The back support has a pair of lateral supports extending outwardly from the opposed side edges thereof. A pair of securement straps are coupled with respect to the back support and the vertical support of the treadmill. The pair of securement straps each have a first end and a second end. The first ends are secured to the pair of lateral supports of the back support. The second ends are couplable with the lower edge of the back support after the securement straps have been wrapped around the vertical support of the treadmill.

6 Claims, 2 Drawing Sheets

TREADMILL SUPPORT BELT

BACKGROUND OF THE INVENTION

The present invention relates to a treadmill support belt and more particularly pertains to providing support and security while using a treadmill.

A treadmill may be used for a variety of different exercises. In particular, walking, jogging, and running are common uses for a treadmill. Standardly, treadmills have side rails and a display panel. Treadmill users have a tendency to grab the side rails or display panel, particularly when fatigued, or when using the treadmill in an inclined mode. However, grabbing the side rails prevents the user from achieving a full upper body workout.

The use of exercise devices and accessories is known in the prior art. More specifically, exercise devices and accessories heretofore devised and utilized for the purpose of exercising and providing support while exercising are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,704,880 to Amatulle discloses a belt capable of being attached to the upright handles of a treadmill allowing the user a free arm workout. U.S. Pat. Nos. 5,176,597 to Byrne and 5,234,392 to Clark disclose the use of belts attached to running exercise machines. U.S. Pat. No. 4,655,447 to Dubrinsky discloses a treadmill assembly with a safety harness capable of suspending the user.

While these devices fulfill their respective, particular objective and requirements, the aforementioned patents do not describe a treadmill support belt for providing support and security while using a treadmill.

In this respect, the treadmill support belt according to the present invention substantially departs from the conventional concepts and designs of the prior art, and in doing so provides an apparatus primarily developed for the purpose of providing support and security while using a treadmill.

Therefore, it can be appreciated that there exists a continuing need for a new and improved treadmill support belt which can be used for providing support and security while using a treadmill. In this regard, the present invention substantially fulfills this need.

SUMMARY OF THE INVENTION

In the view of the foregoing disadvantages inherent in the known types of exercise devices and accessories now present in the prior art, the present invention provides an improved treadmill support belt. The belt provides support to the treadmill user, so as to prevent the treadmill user from grasping the side rails, allowing a complete upper body workout. As such, the general purpose of the present invention, which will be described subsequently in greater detail, is to provide a new and improved treadmill support belt which has all the advantages of the prior art and none of the disadvantages.

To attain this, the present invention essentially comprises a belt portion adapted for coupling with the treadmill user. The belt portion is defined by an elongated member having opposed ends. The opposed ends are adapted for engagement together around the runner. A back support is secured to the belt portion intermediate the opposed ends thereof. The back support is defined by an upper edge, a lower edge, and opposed side edges. The back support has a pair of lateral supports extending outwardly from the opposed side edges thereof. The back support has a storage pouch secured thereto. The lower edge has a pair of tabs extending downwardly therefrom. The tabs each have a D-ring coupled thereto. A pair of securement straps are coupled with respect to the back support and the vertical support of the treadmill. The pair of securement straps each have a first end and a second end. The first ends are secured to the pair of lateral supports of the back support. The second ends each have a clip disposed thereon for coupling with the D-rings of the tabs of the back support after the securement straps have been wrapped around the vertical support of the treadmill.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved treadmill support belt which has all the advantages of the prior art exercise devices and accessories and none of the disadvantages.

It is another object of the present invention to provide a new and improved treadmill support belt which may be easily and efficiently manufactured and marketed.

It is a further object of the present invention to provide a new and improved treadmill support belt which is of durable and reliable construction.

An even further object of the present invention is to provide a new and improved treadmill support belt which is susceptible of a low cost of manufacture with regard to both materials and labor, and which accordingly is then susceptible of low prices of sale to the consuming public, thereby making such a treadmill support belt economically available to the buying public.

Even still another object of the present invention is to provide a new and improved treadmill support belt for providing support and security while using a treadmill.

Lastly, it is an object of the present invention to provide a new and improved treadmill support belt including a belt portion adapted for coupling with the runner. A back support is secured to the belt portion. The back support is defined by an upper edge, a lower edge, and opposed side edges. The back support has a pair of lateral supports extending outwardly from the opposed side edges thereof. A pair of securement straps are coupled with respect to the back support and the vertical support of the treadmill. The pair of securement straps each have a first end and a second end. The first ends are secured to the pair of lateral supports of the back support. The second ends are couplable with the lower edge of the back support after the securement straps have been wrapped around the vertical support of the treadmill.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
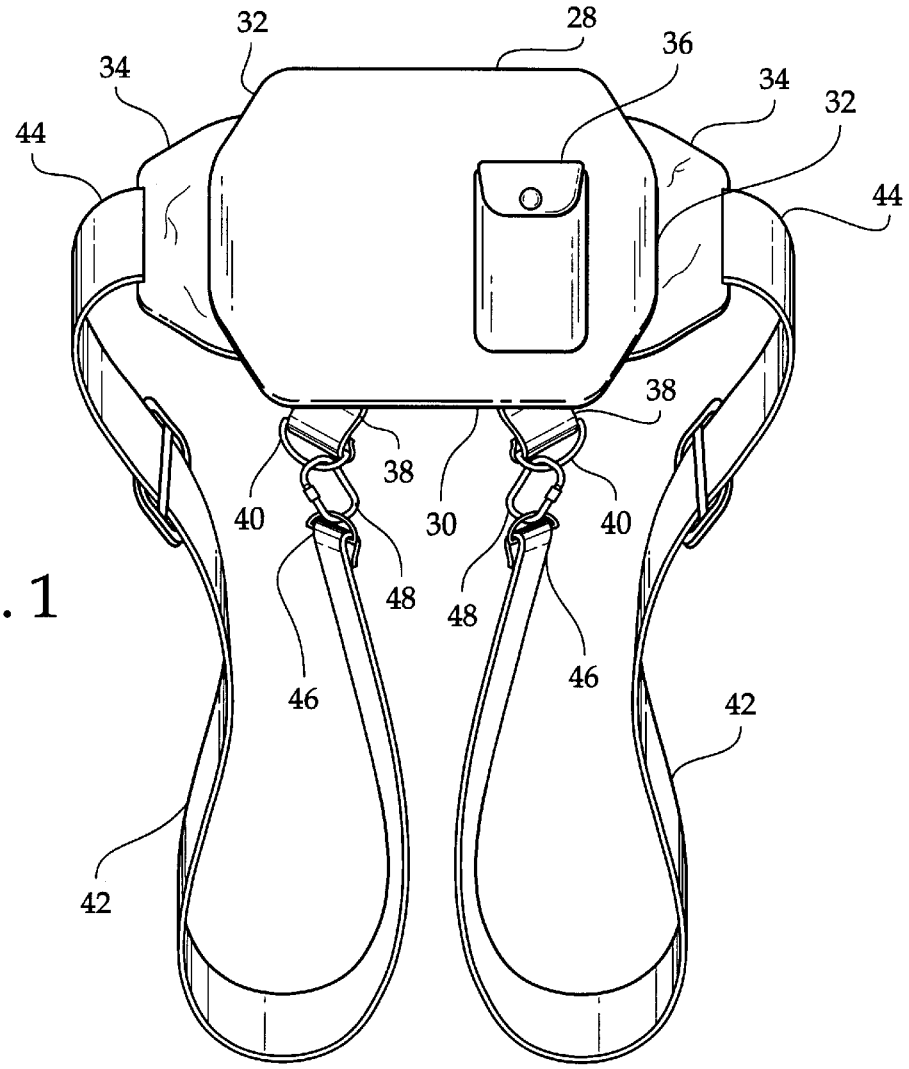
FIG. 1 is a rear view of the preferred embodiment of the treadmill support belt constructed in accordance with the principles of the present invention.
Figure 2:
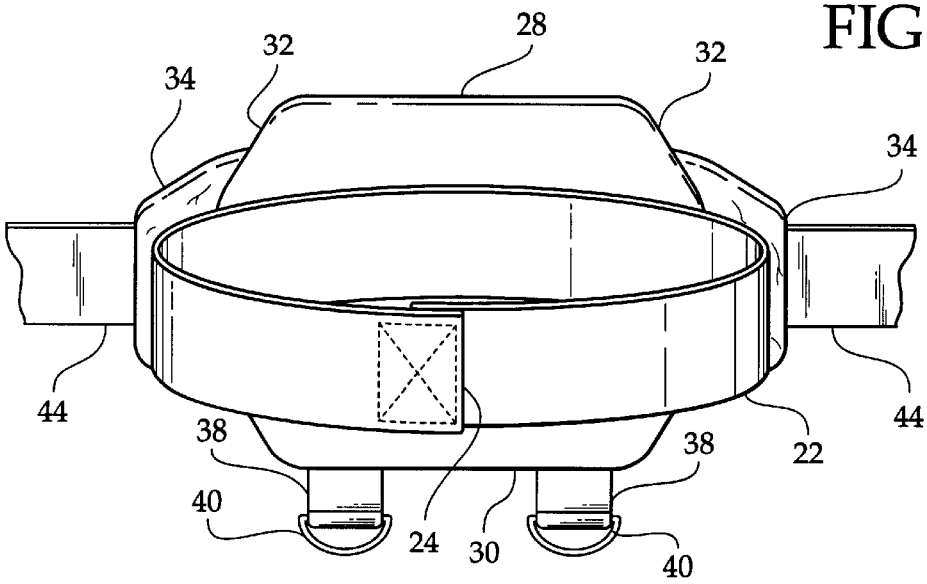
FIG. 2 is a partial front view of the present invention illustrated with the securement straps thereof cut away.
Figure 3:
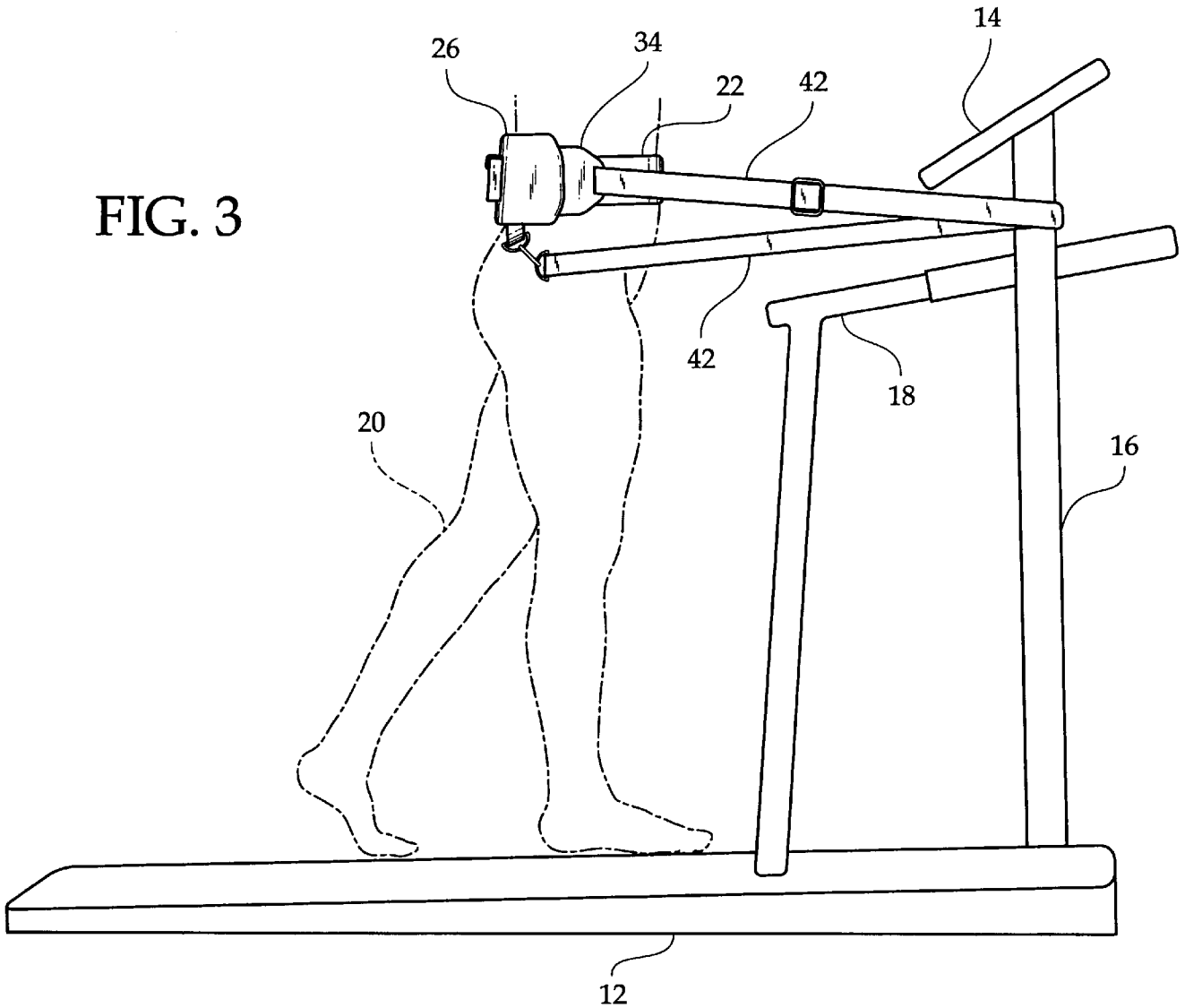
FIG. 3 is a side view of the present invention illustrated in use.

With reference now to the drawings, and in particular, to FIGS. 1 through 3 thereof, the preferred embodiment of the new and improved treadmill support belt embodying the principles and concepts of the present invention and generally designated by the reference number 10 will be described.

Specifically, it will be noted in the various Figures that the device relates to a treadmill support belt for providing support and security to a treadmill user while using a treadmill. In its broadest context, the device consists of a belt portion, a back support, and a pair of securement straps. Such components are individually configured and correlated with respect to each other so as to attain the desired objective.

The present invention is designed for use on a treadmill 12 that includes a control display 14 that is supported by a vertical support 16. Note FIG. 3. The treadmill 14 is also provided with side rails 18 that a treadmill user 20 will typically grasp for support while using the treadmill 12 so as to avoid falling or losing their balance.

The belt portion 22 is adapted for coupling with the user 20. The belt portion 22 is preferably wrapped around the waist of the user 20 and positioned in contact with the lower back to provide support. Note FIG. 3. The belt portion 22 is defined by an elongated member having opposed ends 24. The opposed ends 24 are adapted for engagement together around the runner 20. The opposed ends 24 will be provided with a closure mechanism, such as hook and loop, to facilitate securement to the runner 20.

The back support 26 is secured to the belt portion 22 intermediate the opposed ends 24 thereof. The back support 26 is defined by an upper edge 28, a lower edge 30, and opposed side edges 32. The back support 26 has a pair of lateral supports 34 extending outwardly from the opposed side edges 32 thereof. The back support 26 has a storage pouch 36 secured thereto. The lower edge 30 has a pair of tabs 38 extending downwardly therefrom. The tabs 38 each have a D-ring 40 coupled thereto.

The pair of securement straps 42 are coupled with respect to the back support 26 and the vertical support 16 of the treadmill 12. The pair of securement straps 42 each have a first end 44 and a second end 46. The first ends 44 are secured to the pair of lateral supports 34 of the back support 26. The second ends 46 each have a clip 48 disposed thereon for coupling with the D-rings 40 of the tabs 38 of the back support 26 after the securement straps 42 have been wrapped around the vertical support 16 of the treadmill 12.

In use, the present invention will provide support to the lower back while walking, jogging or running, and will also free the runner's hands by providing the security needed while using the treadmill whereby they will not have to hold onto the side rails 18 for fear that they might fall. The present invention is particularly helpful when the treadmill is in an inclined mode.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A treadmill support belt for providing support and security for a treadmill user while using a treadmill, the treadmill having a control panel supported by a vertical support, the treadmill support belt comprising, in combination:

a belt portion adapted for coupling with the user, the belt portion being defined by an elongated member having opposed ends, the opposed ends being adapted for engagement together around the user;

a back support secured to the belt portion intermediate the opposed ends thereof, the back support being defined by an upper edge, a lower edge, and opposed side edges, the back support having a pair of lateral supports extending outwardly from the opposed side edges thereof, the back support having a storage pouch secured thereto, the lower edge having a pair of tabs extending downwardly therefrom, the tabs each having a D-ring coupled thereto; and a pair of securement straps coupled with respect to the back support and the vertical support of the treadmill, the pair of securement straps each having a first end and a second end, the first ends being secured to the pair of lateral supports of the back support, the second ends each having a clip disposed thereon for coupling with the D-rings of the tabs of the back support after the securement straps have been wrapped around the vertical support of the treadmill.

2. A treadmill support belt for providing support and security for a treadmill user while using a treadmill, the treadmill having a control panel supported by a vertical support, the treadmill support belt comprising, in combination:

a belt portion adapted for coupling with the user;

a back support secured to the belt portion, the back support being defined by an upper edge, a lower edge, and opposed side edges, the back support having a pair of lateral supports extending outwardly from the opposed side edges thereof; and a pair of securement straps coupled with respect to the back support and the vertical support of the treadmill, the pair of securement straps each having a first end and a second end, the first ends being secured to the pair of lateral supports of the back support, the second ends being removable couplable with the lower edge of the back support after the securement straps have been wrapped around the vertical support of the treadmill.

3. The treadmill support belt as set forth in claim 2, wherein the belt portion is defined by an elongated member having opposed ends, the opposed ends being adapted for engagement together around the user.

4. The treadmill support belt as set forth in claim 2, wherein the back support has a storage pouch secured thereto.

5. The treadmill support belt as set forth in claim 2, wherein the lower edge of the back support has a pair of tabs extending downwardly therefrom, the tabs each having a D-ring coupled thereto for coupling with the second ends of the pair of securement straps.

6. The treadmill support belt as set forth in claim 5, wherein the second ends of the securement straps each have a clip disposed thereon for coupling with the D-rings of the tabs of the back support.

* * * * *